US009920583B2

(12) United States Patent
Churchill

(10) Patent No.: US 9,920,583 B2
(45) Date of Patent: Mar. 20, 2018

(54) DRILL STRING CHECK VALVE

(71) Applicant: Churchill Drilling Tools Limited, Aberdeen (GB)

(72) Inventor: Andrew Philip Churchill, Aberdeen (GB)

(73) Assignee: Churchill Drilling Tools Limited, Aberdeen (GB)

( * ) Notice: Subject to any disclaimer, the term of this patent is extended or adjusted under 35 U.S.C. 154(b) by 241 days.

(21) Appl. No.: 14/775,308

(22) PCT Filed: Mar. 11, 2014

(86) PCT No.: PCT/GB2014/050714

§ 371 (c)(1),
(2) Date: Sep. 11, 2015

(87) PCT Pub. No.: WO2014/140553

PCT Pub. Date: Sep. 18, 2014

(65) Prior Publication Data

US 2016/0032669 A1 Feb. 4, 2016

(30) Foreign Application Priority Data

Mar. 12, 2013 (GB) ..... 1304434.2

(51) Int. Cl.
*E21B 21/10* (2006.01)
*E21B 4/02* (2006.01)
(Continued)

(52) U.S. Cl.
CPC ..... *E21B 21/10* (2013.01); *E21B 4/02* (2013.01); *E21B 34/102* (2013.01); *E21B 34/14* (2013.01);
(Continued)

(58) Field of Classification Search
CPC .. E21B 2034/005; E21B 21/10; E21B 34/102; E21B 34/14; E21B 47/18; E21B 4/02
See application file for complete search history.

(56) References Cited

U.S. PATENT DOCUMENTS 2,162,578 A * 6/1939 Hacker ..... E21B 21/10 137/527
4,031,957 A * 6/1977 Sanford ..... C09K 8/72 166/184
(Continued)

FOREIGN PATENT DOCUMENTS

EP 0118994 A1 9/1984
EP 0985797 A2 3/2000
(Continued)

OTHER PUBLICATIONS

International Search Report and Written Opinion for PCT/GB2014/050714 dated Mar. 5, 2015.
Great Britain Search Report for GB1304434.2 dated Jun. 27, 2013.

*Primary Examiner* — James G Sayre
(74) *Attorney, Agent, or Firm* — Dinsmore & Shohl LLP

(57) ABSTRACT

Drill string check valve apparatus comprises a tubular body and a flapper valve mounted in the body with a flapper movable between an open position and a closed position. An axially extending valve retainer is also mounted in the body and is translatable from a running position to a drilling position. In the running position the valve retainer extends through the valve to maintain the flapper in the open position. In the drilling position the valve retainer permits the flapper to move to the closed position to prevent flow up through the body.

44 Claims, 8 Drawing Sheets

(51) Int. Cl.

| | |
|---|---|
| ***E21B 34/10*** | (2006.01) |
| ***E21B 34/14*** | (2006.01) |
| ***E21B 47/18*** | (2012.01) |
| *E21B 34/00* | (2006.01) |

(52) U.S. Cl.
CPC ..... *E21B 47/18* (2013.01); *E21B 2034/005* (2013.01)

(56) References Cited

U.S. PATENT DOCUMENTS

| | | | | |
|---|---|---|---|---|
| 4,294,314 | A * | 10/1981 | Miyagishima | E21B 21/10 137/494 |
| 4,588,035 | A | 5/1986 | Van Gils et al. | |
| 6,125,930 | A * | 10/2000 | Moyes | E21B 34/066 166/317 |
| 2003/0047314 | A1 | 3/2003 | Allamon | |
| 2003/0047315 | A1 * | 3/2003 | Allamon | E21B 21/10 166/332.8 |

FOREIGN PATENT DOCUMENTS

| | | | |
|---|---|---|---|
| WO | 2011019561 | A2 | 2/2011 |
| WO | 2013079926 | A2 | 6/2013 |

* cited by examiner

DRILL STRING CHECK VALVE

CROSS-REFERENCE TO RELATED APPLICATIONS

This application is the U.S. National Phase of PCT/GB2014/050714 filed Mar. 11, 2014, which claims priority of Great Britain Patent Application 1304434.2 filed Mar. 12, 2013.

FIELD OF THE INVENTION

This invention relates to a check valve for a drilling string, which check valve may be incorporated in a drilling bottom hole assembly (BHA). The invention also relates to drilling methods utilising a check valve.

BACKGROUND OF THE INVENTION

In the oil and gas industry, sub-surface hydrocarbon-bearing formations are accessed by drilling from surface using a drill bit mounted on the end of a drill string.

The drill string typically comprises a bottom hole assembly (BHA) which may incorporate the drill bit, heavy walled drill collars, measurement while drilling (MWD) tools, logging while drilling (LWD) tools and rotary steerable drilling systems (RSDS). The BHA will be connected to a large number of relatively small diameter drill pipe sections which extend to surface.

Drilling BHAs will sometimes include check or float valves which allow drilling fluid to be pumped downhole through the drill string to the drill bit, but which prevent fluid from flowing into the drill string and up the string to surface. Indeed, some operators now insist that two independent check valves are provided in every drilling BHA, particularly when drilling high pressure high temperature (HPHT) wells. In the absence of one or more check valves in the BHA, in the event of a "kick" (a sudden increase in fluid pressure) or a sudden influx of gas from a hydrocarbon-bearing formation, the gas can percolate up and will then tend to expand and flow rapidly up through the bore, and up through the drill string; this is extremely dangerous. The blowout preventer (BOP) provided at the surface of the bore may be used to prevent fluid escaping from the annulus between the drill string and the wall of the hole. However, the BOP can only prevent fluid passing up through the drill pipe by severing the pipe with the blind-shear rams, which is of course a last resort method.

There are some disadvantages associated with including check valves in the BHA. Primarily, incorporating one or more check valves in the BHA prevents the drill string from self-filling as the drill string is made up and tripped or lowered into the bore in preparation for a drilling operation. To avoid the drill string collapsing due to the hydrostatic pressure exerted on the string by the fluid in the annulus, the operator has to "top fill" the drill string at intervals as the drill string is tripped into the bore.

It is known to provide flapper type check valves having an orifice in the flapper. This minimises the need for top filling, but the valve does not provide a complete pressure barrier and relying on such a valve may be unacceptable to some operators, particularly in HPHT wells. Alternatively, flapper type valves are available in which a sprung latch initially holds the flapper partially open, allowing self-filling. However, as soon as any fluid is pumped through the string, for example, a shallow test of the flow activated tools in the BHA, or to ensure that the jetting nozzles and the drill bit are not blocked, the flapper will open, releasing the latch, such that the flapper closes when the pumps are turned off. The drill string must then be top filled for the remainder of the tripping operation.

WO 2008/005289 describes a downhole well control device that includes a bypass one-way valve. However, as best understood, the one-way valve appears to be provided in combination with a bypass valve to permit flow from a pipe bore into an annulus when the bypass valve is open but to prevent flow from the annulus into the pipe bore.

Check valves or floats are used in non-drilling operations in combination with relatively large diameter bore-lining tubing such as casing and liner. Davis-Lynch, LLC offer Davis Self-Filling Float Shoes and Float Collars and Halliburton also offer an Advantage IPV Insert Poppet Valve, as described in U.S. Pat. No. 5,647,434. These valves or floats are run into a bore on the lower end of a string of bore lining casing or liner. Top filling a casing or liner string is relatively straightforward, due to the large diameter of the tubing. Also, an operator will often have a wash-down tool rigged up to allow circulation of fluid while running in hole, making it straightforward to top fill while running in. However, such check valves and floats are occasionally initially held open, for example by locating beads or balls between the valve member and valve seat, which balls or beads may be displaced by pumping fluid down through the string, allowing the valve to close. This obviates the requirement for top filling, however the primary reason for initially holding the valve open is to minimise the pressure surge created by running the large diameter tubing into the bore; the string is likely to be only slightly smaller than the bore, such that fluid would otherwise be trapped in the bore ahead of the string and the resulting pressure increase could damage or break down the formation, compromising subsequent cementing and production operations. However, the reduction in the risk of damaging the formation due to a pressure surge must be balanced against the risks involved in running an open large diameter string into the bore, such that some operators prefer to maintain the valves or floats closed, and run the tubing in relatively slowly. Also, if it is considered necessary or desirable to circulate fluid through the string including a valve held open by beads or balls, for example to facilitate progress of the string through a tight spot in the bore or to displace settled cuttings, an initially open valve will then close.

Once at the desired depth and following a cementing operation, the heavier liquid cement that has been pumped down through the string and the valve, and up into the annulus, will not be able to u-tube back into the casing/liner through the closed valve whilst the cement is setting.

U.S. Pat. No. 6,401,822 to Baugh describes a check valve assembly for the bottom of a casing string which is configured to provide a relatively high open area from a variety of flow paths to allow the string to be run in relatively quickly without fluid pressure build up in the formation. Multiple check valves are provided to provide for assurance of ultimate closure. The various flow paths and the check valves are closed by dropping a ball into the string when the casing has reached to desired depth.

Applicant's International Patent Application PCT/GB2012/052924, the disclosure of which is incorporated herein in its entirety, discloses a number of check valve configurations.

SUMMARY OF THE INVENTION

According to the present invention there is provided drill string check valve apparatus comprising:

a tubular body:

a flapper valve mounted in the body and having a flapper movable between an open position and a closed position; and an axially extending valve retainer mounted in the body and being translatable from a running position to a drilling position, in the running position the valve retainer extending at least partially through the valve to maintain the flapper in the open position, and in the drilling position the valve retainer permitting the flapper to move to the closed position to prevent flow up through the body.

According to another aspect of the present invention there is provided a drilling method comprising:

running a drill string into a bore with a flapper valve located at a distal end of the string and held in an open configuration by an axially extending valve retainer extending at least partially through the valve; and translating the valve retainer to a position beyond the valve to permit the valve to assume a closed configuration and prevent flow up through the body.

In the closed position the valve may serve as a check valve, allowing fluid to be pumped down through the string from surface to a drill bit during a drilling operation, but preventing flow in the opposite direction.

The method may comprise providing a tool in the string between the flapper valve and the drill bit, pumping fluid from the surface through the flapper valve and permitting communication via pressure pulses between the tool and the surface. The communicating via pressure pulses between the tool and the surface may take place while the flapper valve is held in the open configuration. Alternatively, or in addition, the communicating via pressure pulses between the tool and the surface may take place while the flapper valve is permitted to assume the closed configuration. The tool may comprise one or more of a mud motor, MWD tool and LWD tool.

In certain embodiments of the invention the flapper may be retained in an open position, and prevented from closing, simply by locating the valve retainer within the valve. This allows the apparatus to employ relatively simple or conventional flapper or check valves which would not normally be configurable in an open configuration.

The valve retainer may take any appropriate form and may comprise a valve retainer member. The valve retainer member may comprise a tube or pipe and may extend at least part way through the valve, holding the flapper in the open position. The use of the tubular retainer member facilitates provision of a smooth or regular passage through the open valve and may provide a degree of protection for elements of the open valve. A tubular retainer member may also provide a substantially cylindrical outer surface, facilitating translation of the member through the valve. The tube or pipe will also function as a valve retainer in any rotational orientation. The valve may be biased to assume the closed position, such that translating the valve retainer member out of the open valves permits the flapper to move to the closed position. In other embodiments the valve retainer member may comprise another form or structure, such as a bar or rod mounted in the body so as to hold the flapper open.

The valve retainer may maintain the valve in a fully open position, such that the open valve defines a substantially unobstructed bore.

The valve may be operated in combination with an activating device which cooperates with the valve retainer and allows the retainer to be translated to the drilling position. The activating device may be configured to be dropped or pumped from surface. The activating device may be configured to facilitate application of a fluid pressure force to the valve retainer. For example, the activating device may be a ball, plug or dart configured to engage with a seat on the valve retainer, which may simply be an end surface, to substantially occlude the body. The activating device may be arranged to dissolve, degrade or erode after a time, such that the body is then no longer occluded. The operator may then access the portion of the string below the apparatus. The activating device may be arranged to engage with the valve retainer to avoid subsequent separation, for example being provided with a catch or latch arrangement.

The valve retainer may be releasably retained in the running position, for example by one or more releasable retainers such as shear screws, shear pins, or a sprung or a collapsible retainer. This decreases the likelihood of accidental release of the valve retainer, and may permit fluid to be pumped through the apparatus at an elevated flow rate without release of the retainer. In use, this may permit fluid to be pumped through the drill string during run in to, for example, test MWD tools and the like or ensure that jetting nozzles in a drill bit are clear, without reconfiguring the valve. An operator may even choose to carry out some drilling with the valve in the running position, for example in drilling out a cement plug at the lower end of a section of cemented casing, and then optionally drilling beyond the end of the casing to accommodate a hole opener located on the string between the bit and the valve, which hole opener may be activated by dropping a ball or dart through the valve.

The apparatus may include a catcher located below the valve, for receiving and retaining the valve retainer. The catcher may also receive and retain an activating device, where present. The catcher may be configured to provide a flow path around the retainer.

The apparatus may be incorporated in a drilling bottom hole assembly (BHA). The apparatus may be positioned above or below one or more of an MWD tool, LWD tool or mud motor.

The apparatus may comprise more than one valve. Two valves may be provided, and a valve retainer may be provided for each valve, or a single retainer may be associated with both valves.

The body may be a box-box tubular member, that is a member having a female coupling at each end, to cooperate with an appropriate pin or male coupling.

The body may include an internal shoulder and the apparatus may be configured such that upwards pressure forces applied to a closed valve, which may be the lower of two valves, are transferred to the body via the shoulder. Alternatively or in addition, upwards pressure forces applied to a closed valve, which may be the upper of two valves, may be held by the pin connection of an adjacent drill string element.

The valve retainer may comprise an assembly of a retaining member for extending through the valve and a mounting member for locating the retaining member in the body. The retaining member may be releasably secured to the mounting member. The mounting member may be configured to be retained in the body by an adjacent string element, for example by the pin connection of an adjacent tubular. Thus, in selected embodiments the assembly may be retained in the body without the requirement for fasteners or fixings.

The valve retainer may be configured to permit the retainer to be axially translated into the valve and body from one end of the body, a leading end of the retainer moving the flapper to the open position as the retainer is advanced into the body.

According to a further aspect of the present invention there is provided drill string check valve apparatus comprising:

a tubular body:

tandem flapper valves mounted in the body, each valve having a flapper movable between an open position and a closed position; and a valve retainer mounted in the body and being translatable from a running position to a drilling position, in the running position the valve retainer extending at least partially through the valves to maintain the flappers in the open position, and in the drilling position the valve retainer permitting the flappers to move to the closed position to prevent flow up through the body.

According to a still further aspect of the present invention there is provided a drilling method comprising:

running a drill string into a bore with tandem flapper valves located at a distal end of the string and held in an open configuration by a valve retainer extending at least partially through the valves; and translating the valve retainer to a position beyond the valves to permit the valves to assume a closed configuration and prevent flow up through the body.

These further aspects of the invention may be provided in combination with some or all of the optional features described above with reference to the initial two aspects.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
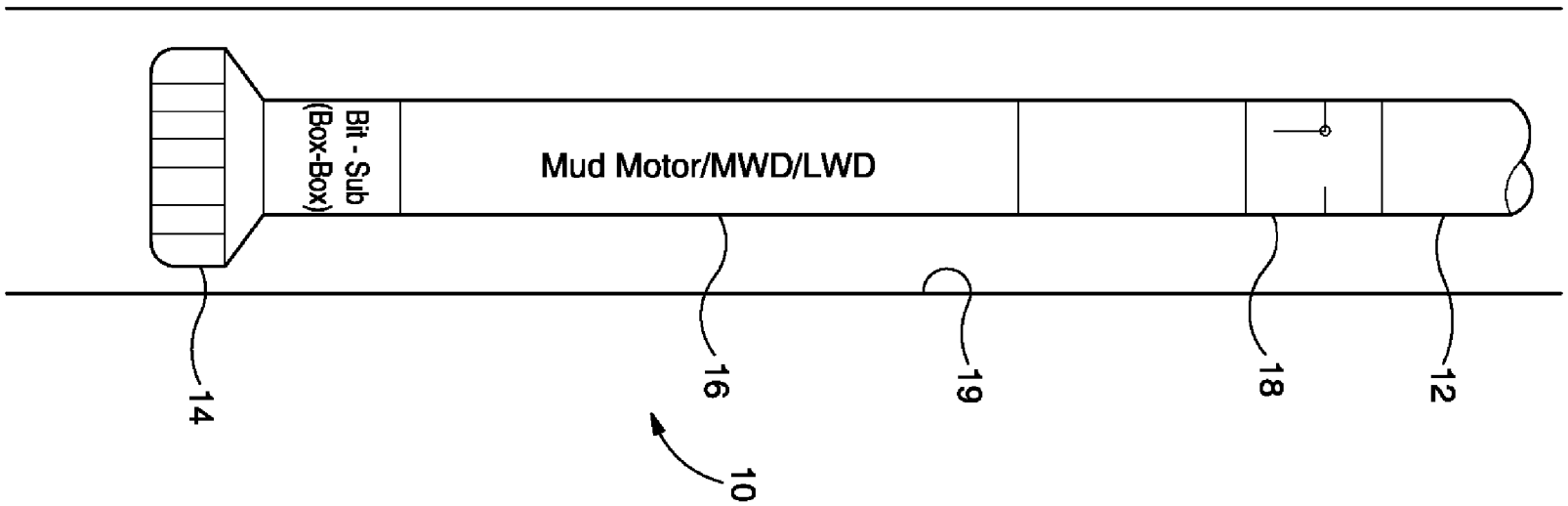
FIG. 1 is a schematic illustration of a bottom hole assembly (BHA) incorporating drill string check valve apparatus in accordance with an embodiment of the present invention.

Reference is first made to FIG. 1 of the drawings, a schematic illustration of a drilling bottom hole assembly (BHA) 10 in accordance with an embodiment of the present invention. The BHA 10 is configured for mounting on a drill string 12 and comprises a drill bit 14, an assembly 16 including one or more of a mud motor, MWD tool or LWD tool, and a tandem flapper type check valve apparatus 18. As will be described, the BHA 10 allows an operator to run the drill string 12 into a bore 19 with the apparatus 18 in an open, running configuration such that the string 12 will self-fill; as the drill string 12 is made up and the BHA 10 moves down into the fluid filled bore 19, the fluid will flow into the string 12 through the jetting nozzles in the drill bit 14. If desired, the operator may circulate drilling fluid through the string 12 as the string 12 is being tripped into the bore to, for example, carry out a shallow test of the MWD tool 16. Once the string 12 has been run into an appropriate depth the operator may reconfigure the apparatus 18 to a drilling configuration ready for a drilling operation, during which the drilling fluid may be pumped down through the string 12 and through the reconfigured apparatus to the bit 14. At the bit 14 the drilling fluid will pass through the jetting nozzles and then return to surface through the annulus between the string 12 and the bore wall. However the reconfigured apparatus 18 will prevent fluid from flowing in through the jetting nozzles and up the string 12, as might otherwise occur, for example, in the event of a "kick".

Figure 2:
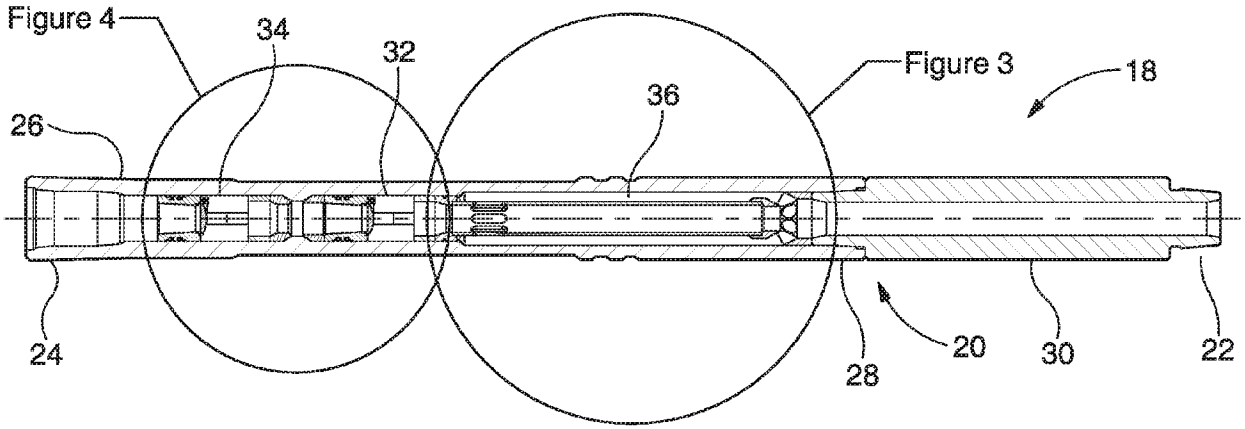
FIG. 2 is a sectional view of the check valve apparatus of FIG. 1.

Reference is now also made to FIGS. 2 through 7 of the drawings, which illustrate details of the check valve apparatus 18 of FIG. 1. Reference is first made in particular to FIG. 2, which illustrates elements of the apparatus 18. As the apparatus 18 is to be incorporated into the drill string 12, the apparatus 18 includes a tubular body 20 having appropriate pin and box end connections 22, 24, although the primary elements of the apparatus 18 are contained within a tubular body portion 26 having box connections 24, 28 at both ends, the lower portion of the body 20 being formed by a pin-pin body portion 30.

Those of skill in the art will recognise that the location of the apparatus 18 in the BHA in this embodiment differs from conventional check valve or float location. Typically, a conventional float valve is placed inside the bottom of the bit sub, that is the joint of tubing located directly above the drill bit, and that has a box-box configuration. Alternatively, a conventional float may be located in a near-bit stabiliser, with the inner bore of the stabiliser being sized to accommodate the float. In this position the float is relatively inaccessible, being below the MWD tool, however as there is no requirement to activate or actuate a conventional float, operators have not considered this an issue, and also take comfort from the location of the check valve directly above the bit.

Figure 3:
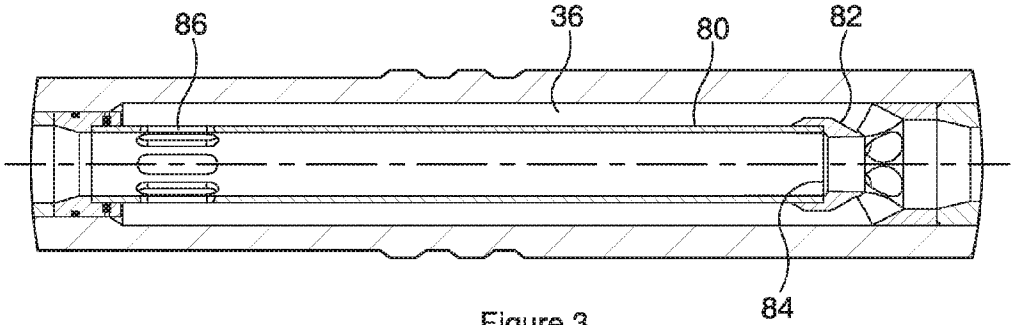
FIG. 3 is an enlarged view of area 3 of FIG. 2, showing a catcher assembly.
Figure 4:
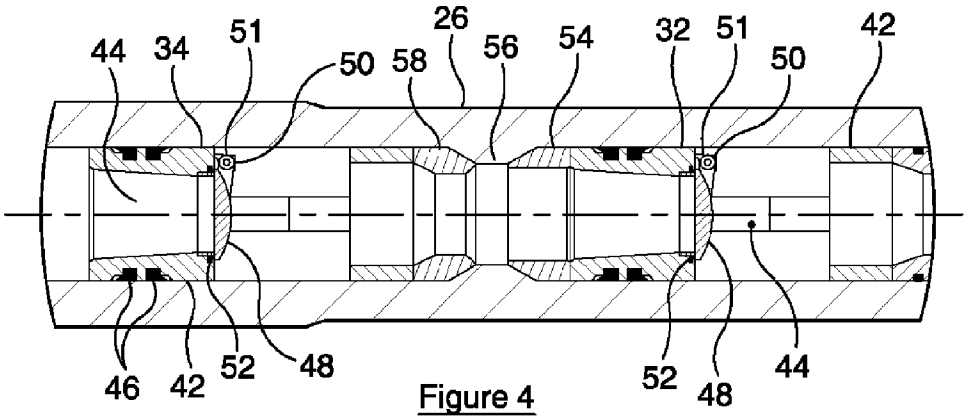
FIG. 4 is an enlarged view of area 4 of FIG. 2, showing two check valves.
Figure 5:
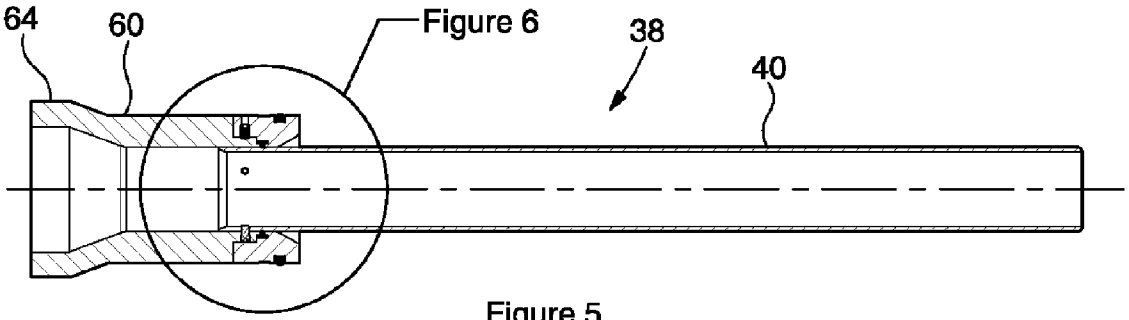
FIG. 5 is a sectional view of a valve retainer assembly of the valve apparatus of FIG. 1.
Figure 6:
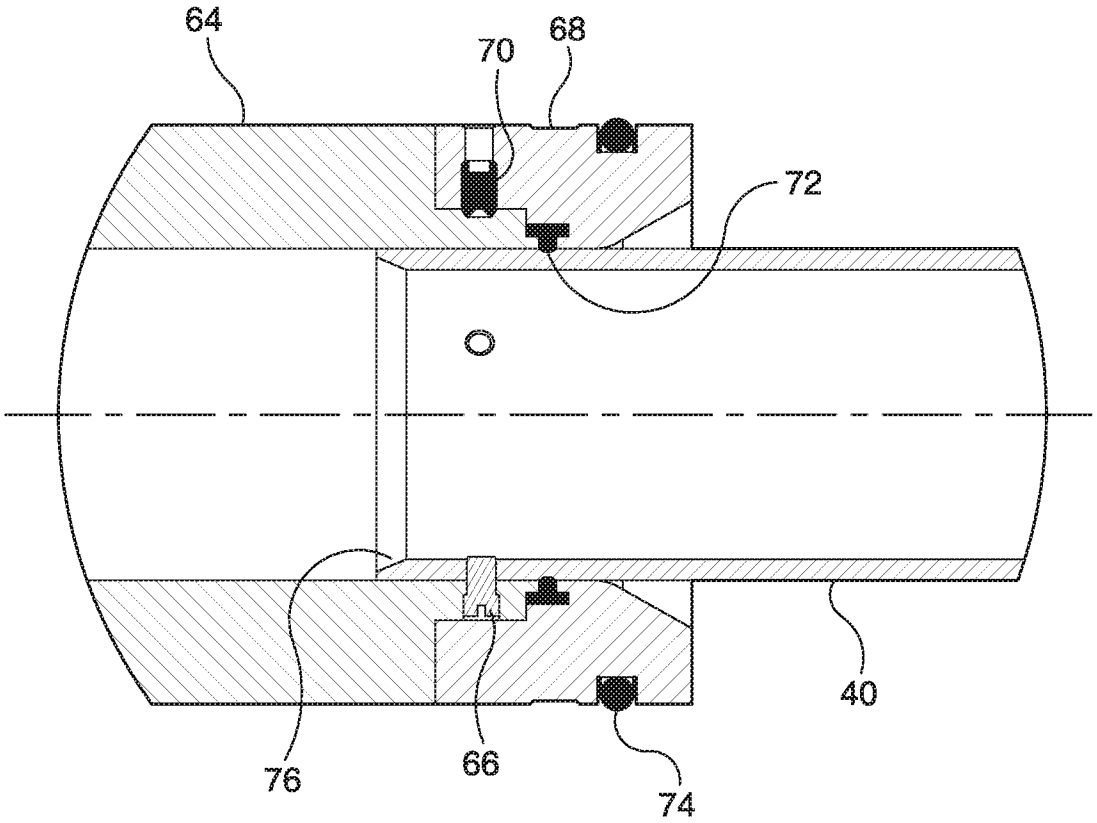
FIG. 6 is an enlarged view of area 6 of FIG. 5, showing a mounting member of the valve retainer assembly.
Figure 7:
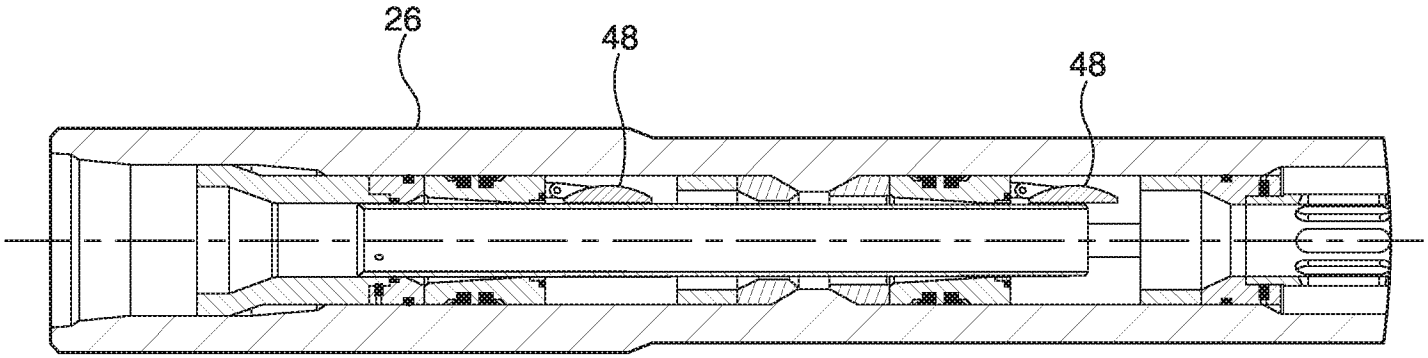
FIG. 7 is a sectional view of an upper portion of the check valve apparatus of FIG. 1, showing the apparatus in a running configuration.

In the apparatus in accordance with this embodiment of the present invention, mounted within the upper body portion 26 are two tandem flapper type check valves 32, 34, as illustrated in greater detail in FIG. 4, and a catcher 36, as illustrated in greater detail in FIG. 3, is provided below the valves 32, 34. In the running configuration a valve retainer assembly 38, as illustrated in FIG. 5, is positioned in the body portion 26 and extends through the check valves 32, 34, as illustrated in FIG. 7. As will be described, a pipe 40 forming part of the assembly 38 may be subsequently released to travel into the catcher 36.

The check valves 32, 34 are, in this embodiment, identical and each comprise a frame or body 42 defining a through bore 44 and being dimensioned to fit within the body bore. An upper part of the body 42 carries two circumferential seals 46 to engage with the wall of the body. A flapper 48 is mounted to the body 42 via a pivot pin 50, the mounting including a spring 51 to bias the flapper to engage a seat 52 on an upper part of the body 42 and close the through bore 44. When fully open, the flapper 48 lies substantially parallel to the body axis, as illustrated, for example, in FIG. 7.

The lower or primary valve 32 and the body portion 26 are configured such that the valve 32 may be inserted and removed from the body bore from the lower end of the body portion 26 (the right-hand end of the body portion 26 as shown in FIG. 2). A thrust support 54 is provided between the upper end of the valve body 42 and a shoulder 56 provided in the otherwise cylindrical body bore. If the closed valve 32 experiences elevated pressure from below, the resulting fluid pressure force is transferred to the body portion 26 via the thrust support 54 and the shoulder 56.

The upper check valve 34 is located to the other side of the shoulder 56 and is spaced from the shoulder 56 by a retainer stabiliser 58.

The valve retainer assembly 38 includes a mounting member 60 which is dimensioned and shaped to engage the upper end face of the upper check valve 34. The mounting member 60 is releasably attached to the retainer pipe 40 which, with the apparatus 18 in the running configuration, extends through the check valves 32, 34. The mounting member 60 includes an upper funnel portion 64 which is of larger external and internal diameter to locate the mounting member 60 in the upper box connection of the body portion 26 and to provide a lead-in to the smaller diameter of the retainer pipe 40. The funnel portion 64 is secured to the pipe 40 by three shear screws 66 (see FIG. 6). A seal collar 68 is mounted on the lower end of the funnel portion 64, being secured to the funnel portion 64 by grub screws 70, and carries an inner seal 72 for engaging the upper end of the pipe 62, and an outer seal 74 for engaging with the body wall. The retainer pipe 40 has an upper end which is chamfered to form a seat 76 but the pipe 40 is otherwise of plain cylindrical form. The pipe 40 is dimensioned to extend through the upper valve 34 and partway through the lower valve 32, such that the pipe 40 holds both valve 32, 34 fully open.

Figure 8:
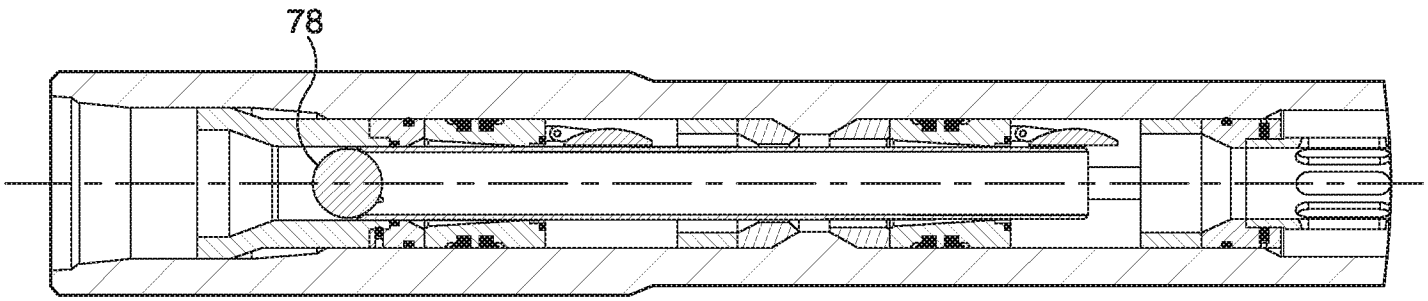
FIG. 8 corresponds to FIG. 7, but shows an activating device in the form of a ball landed in the check valve apparatus.

When it is desired to reconfigure the apparatus 18 to the drilling configuration an activating device is pumped through the string from surface to land on the pipe seat 76. FIG. 8 of the drawings shows the valve after an activating device in the form of a ball 78 has landed on the seat 76, allowing the operator to create a pressure differential across the valve retainer assembly 38. The fluid pressure force applied across the cross sectional area of the seal collar 68 is supported by the upper check valve body 42, the stabiliser 58 and the body shoulder 56. However, the force created across the pipe 40 is only supported by the shear screws 66, which will fail on experiencing a predetermined force.

Once the shear screws 66 fail, the pipe 40 may translate axially relative to the mounting member 60 and move downwards through the body portion 26. As the upper end of the pipe 40 moves beyond the upper check valve 34, and then beyond the lower check valve 32, the respective flappers 48 may move to the closed position. The pipe 40 and ball 78 continue to translate downwards into the catcher 36. The catcher 36 includes a central tube 80 which is supported at its lower end by a spider 82 with an inner profile 84 sized to act as a stop for the lower end of the pipe 40. The upper end of the catcher tube 80 is slotted to form flow openings 86 which, with the pipe 40 and the ball 78 within the tube 80 (FIG. 9*b*), are located just above the ball 78, such that fluid may flow through the openings 86 into an annulus 88 between the tube 80 and the body 20, and then out of flow openings 90 formed in the spider 82, and towards the distal end of the drill string 12.

Figure 9A:
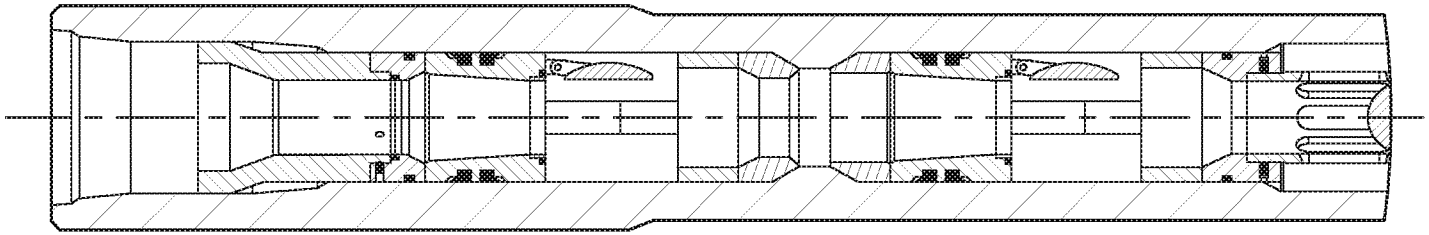
FIGS. 9*a* and 9*b* show the check valve apparatus of FIG. 7, but in a drilling configuration after activation using the ball of FIG. 8.
Figure 9B:
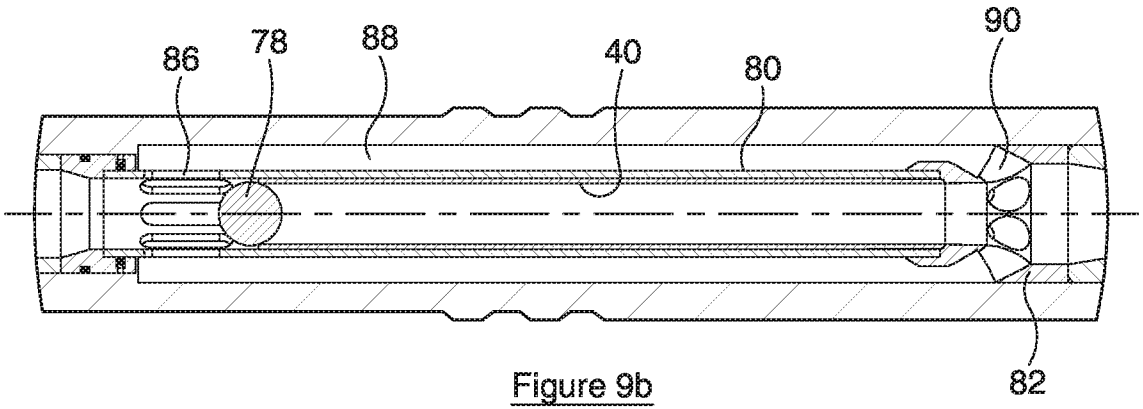

Thus, in the drilling configuration, the apparatus 18 operates as a check valve, the valves 32, 34 opening in response to fluid being pumped down through the string (as illustrated in FIG. 9*a*), but holding pressure in the event of reverse flow, that is a higher pressure being experienced below the apparatus 18. While fluid is being pumped through the apparatus 18 from surface the valves 32, 34 will remain open, permitting communication via pressure pulses between the tools 16 and surface.

In some embodiments the ball 78 may be formed of a material which dissolves after a time. Accordingly, at some point after the apparatus 18 has been reconfigured to the drilling configuration, the pipe 40 may again be unobstructed, facilitating flow through the apparatus 18 and facilitating access to the portion of the BHA below the apparatus 18.

Figure 10A:
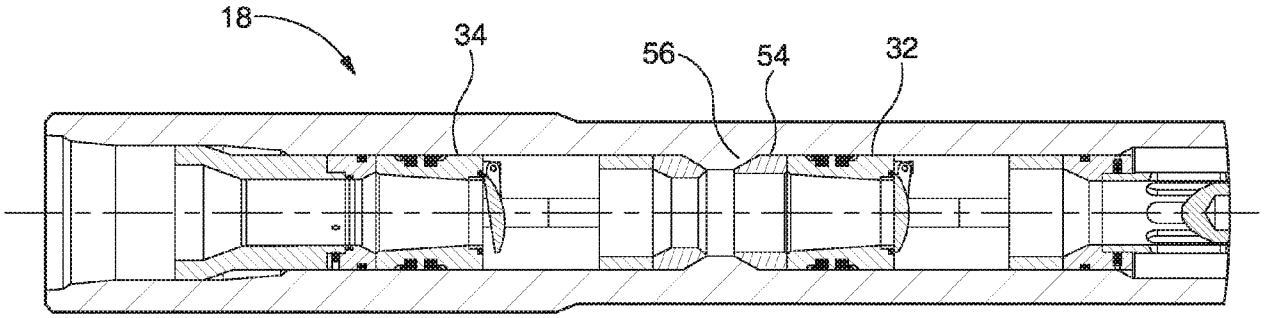
FIGS. 10*a* and 10*b* show the check valve apparatus of FIG. 7, but in the drilling configuration after activation by a dart.
Figure 10B:
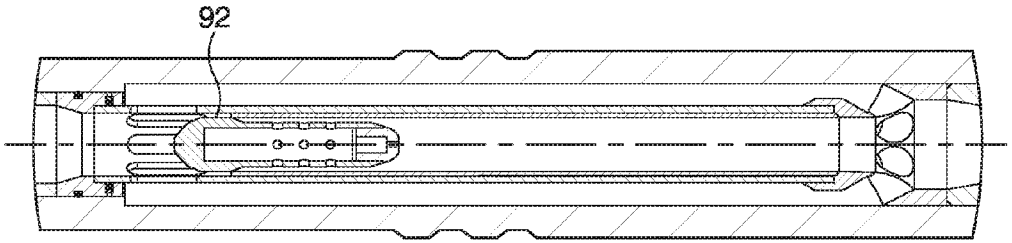

Reference is now made to FIGS. 10*a* and 10*b* of the drawings, which illustrate the check valve apparatus 18 as described above, but in which the activating device has taken the form of a dart 92. The apparatus 18 is illustrated holding pressure from below, with the lower, primary valve 32 experiencing a pressure differential which, as noted above, is transferred to the body 22 via the thrust support 54 and the shoulder 56. The upper valve 34 will only experience a pressure differential in the event of failure of the primary valve 32.

In some embodiments the dart 92 may incorporate a portion or core of relatively soft material which dissolves or erodes after a time. As with a dissolving ball, this will facilitate fluid passage and access to the portion of the BHA below the apparatus 18.

In a further embodiment the dart 92 or pipe 40 may include a latch or catch that positively retains the dart 92 in the pipe 40, ensuring that the dart 92 does not move out of the pipe 40 and interfere with the operation of the valves 32, 34. Similarly, the pipe 40 and catcher 36 may be configured to positively retain the pipe 40 within the catcher tube 80.

It will be apparent to those of skill in the art that the check valve apparatus 18 described above offers many advantages to the operator. The apparatus 18 is of relatively simple construction and, if desired, may utilise substantially conventional check valves which do not normally provide the option of being maintained in an open configuration. The valve retainer assembly 38 is of a simple mechanical form and minimises the likelihood of the check valves being inadvertently closed. Also, in the embodiment described above the use of a relatively thin-walled retainer pipe 40 provides a clear and unobstructed bore through the apparatus 18 without restricting the bore diameter, maintains the flappers fully open, and also provides a degree of protection for the flappers and the associated valve seats. The use of the pipe 40 also facilitates activation of tools or devices provided in the BHA below the apparatus 18. For example, balls or darts of appropriate dimensions may be passed through the apparatus 18 in the running configuration to, for example, activate a hole opener provided on the string 12 between the bit 14 and the apparatus 18.

When it is desired to reconfigure the valves 32, 34, this may be achieved easily and quickly simply by dropping or pumping an appropriate activating device into the string. The mechanism for releasing the retainer pipe 40 is very straightforward and thus reliable and predictable. Also, the retainer pipe 40 is moved away from the valves 32, 34 and thus will not interfere with the operation of the valves in the drilling configuration.

The illustrated embodiment is also configured for ease of manufacture and assembly, requiring no fixings or fasteners to be provided between the body 20 and the internal elements of the apparatus 18.

It will also be apparent to those of skill in the art that many of the advantages provided by the above described embodiment may be provided by valves having other combinations or features. For example, some operators may only require provision of a single check valve, and in such an apparatus the valve retainer and the catcher could be correspondingly shorter, providing a more compact apparatus. Also, although a retainer in the form of a pipe provides a number of advantages, the valves could be maintained in the open position by, for example, a single bar or rod mounted relative to a suitable seat.

The invention claimed is:

1. A drilling method comprising:

running a drill string into a bore with a flapper valve located towards a distal end of the string and above a drill bit mounted on the distal end of the string, with the flapper valve held in an open configuration by an axially extending valve retainer extending at least partially through the valve;

translating the valve retainer to a position beyond the valve into a catcher below the valve and above the drill bit, wherein the catcher receives and retains the valve retainer to permit the valve to assume a closed configuration and prevent flow up through the body; and then drilling the bore while pumping fluid down through the string from surface to the drill bit.

2. The drilling method of claim 1, comprising providing a tool in the string between the flapper valve and the drill bit, pumping fluid from the surface through the flapper valve and permitting communication via pressure pulses between the tool and the surface.

3. The drilling method of claim 2, comprising communicating via pressure pulses between the tool and the surface while the flapper valve is held in the open configuration.

4. The drilling method of claim 2, comprising communicating via pressure pulses between the tool and the surface while the flapper valve is permitted to assume the closed configuration.

5. The drilling method of claim 2, wherein the tool comprises one or more of a mud motor, MWD tool and LWD tool.

6. The method of claim 1, comprising pumping fluid through the open flapper valve.

7. The method of claim 1, comprising translating an activating device down through the drill string to engage with the valve retainer and substantially occlude the string, creating a fluid pressure differential across the valve retainer, and utilising the fluid pressure differential to translate the valve retainer beyond the valve.

8. The method of claim 7, comprising subsequently dissolving, degrading or eroding at least a portion of the activating device.

9. The method of claim 1, comprising pumping fluid through the string and through or around the caught retainer to the drill bit.

10. The method of claim 1, comprising providing two flapper valves and holding both valves open with the valve retainer.

11. The method of claim 1, comprising locating a first valve in a body through a first end of the body and locating a second valve in the body through a second end of the body.

12. The method of claim 1, comprising locating the valve in a body and axially translating the valve retainer into the valve and the body from one end of the body such that a leading end of the retainer moves the flapper to the open position as the retainer is advanced into the body.

13. The method of claim 1, comprising incorporating the valve in a drilling bottom hole assembly (BHA) above an MWD tool.

14. Drill string check valve apparatus comprising:

a tubular body:

a flapper valve mounted in the body and having a flapper movable between an open position and a closed position;

an axially extending valve retainer mounted in the body and being translatable from a running position to a drilling position, in the running position the valve retainer extending at least partially through the valve to maintain the flapper in the open position, and in the drilling position the valve retainer permitting the flapper to move to the closed position to prevent flow up through the body, in the closed position the valve operating as a check valve, allowing fluid to be pumped down through the drill string from surface to a drill bit, but preventing flow in the opposite direction, wherein the valve retainer is configured to be translated beyond the valve to permit the valve to assume the closed configuration; and a catcher located below the valve, for receiving and retaining the valve retainer.

15. The apparatus of claim 14, wherein the valve retainer comprises a valve retainer member.

16. The apparatus of claim 15, wherein the valve retainer member comprises a tubular member.

17. The apparatus of claim 16, wherein the tubular member defines a substantially cylindrical outer surface.

18. The apparatus of claim 16, wherein the tubular member defines a substantially cylindrical inner surface.

19. The apparatus of claim 14, wherein the flapper is biased towards the closed position.

20. The apparatus of claim 14, wherein the valve retainer maintains the valve in a fully open position, such that the open valve defines a substantially unobstructed bore.

21. The apparatus of claim 14, in combination with an activating device configured to cooperate with the valve retainer and allow the retainer to be translated to the drilling position.

22. The apparatus of claim 21, wherein the activating device is configured to be dropped or pumped from surface.

23. The apparatus of claim 21, wherein the activating device is configured to facilitate application of a fluid pressure force to the valve retainer.

24. The apparatus of claim 23, wherein the activating device is configured to engage with a seat on the valve retainer and substantially occlude the body.

25. The apparatus of claim 21, wherein the activating device is configured to at least partially dissolve, degrade or erode.

26. The apparatus of claim 21, wherein the activating device is configured to positively engage with the valve retainer.

27. The apparatus of claim 14, wherein the valve retainer is releasably retained in the running position.

28. The apparatus of claim 27, wherein the valve retainer is releasably retained in the running position by one or more releasable retainers.

29. The apparatus of claim 14, wherein the catcher is configured to also receive and retain an activating device.

30. The apparatus of claim 14, wherein the catcher is configured to provide a flow path around the caught retainer to permit fluid to be pumped down through the string from surface to a drill bit located below the apparatus on the drill string.

31. The apparatus of claim 14, comprising more than one valve.

32. The apparatus of claim 14, comprising two flapper valves.

33. The apparatus of claim 32, wherein a single valve retainer maintains both valves open.

34. The apparatus of claim 14, wherein the body includes a box-box tubular member.

35. The apparatus of claim 14, wherein the body includes an internal shoulder and the apparatus is configured such that upwards pressure forces applied to a closed valve are transferred to the body via the shoulder.

36. The apparatus of claim 14, wherein the apparatus is configured such that upwards pressure forces applied to a closed valve are held by an adjacent string element.

37. The apparatus of claim 14, wherein the valve retainer comprises an assembly of a retaining member for extending through the valve and a mounting member for locating the retaining member in the body.

38. The apparatus of claim 37, wherein the retaining member is releasably secured to the mounting member.

39. The apparatus of claim 37, wherein the mounting member is configured to be retained in the body by an adjacent string element.

40. The apparatus claim 14, wherein the valve retainer is configured to be axially translated into the valve and body from one end of the body, a leading end of the retainer moving the flapper to the open position as the retainer is advanced into the body.

41. A drilling bottom hole assembly (BHA) incorporating apparatus according to claim 14, the apparatus being located above a drill bit.

42. The drilling BHA of claim 41, wherein one or more of a mud motor, MWD tool and LWD tool is located between the apparatus and the drill bit.

43. Drill string check valve apparatus comprising:

a tubular body configured for location in a drill string above a drill bit:

tandem flapper valves mounted in the body, each valve having a flapper movable between an open position and a closed position;

a valve retainer mounted in the body and being translatable from a running position to a drilling position, in the running position the valve retainer extending at least partially through the valves to maintain the flappers in the open position, and in the drilling position the valve retainer permitting the flappers to move to the closed position, in the closed position the flappers operating as check valves, allowing fluid to be pumped down through the drill string from surface to the drill bit, but preventing flow in the opposite direction, wherein the valve retainer is configured to be translated beyond the valve to permit the valve to assume the closed configuration; and a catcher located below the valve, for receiving and retaining the valve retainer.

44. A drilling method comprising:

running a drill string into a bore with tandem flapper valves located at a distal end of the string and above a drill bit mounted on the distal end of the string, with the flapper valves held in an open configuration by a valve retainer extending at least partially through the valves;

translating the valve retainer to a position beyond the valves into a catcher located below the valves and above the drill bit, wherein the catcher receives and retains the valve retainer to permit the valves to assume a closed configuration and prevent flow up through the body; and then drilling the bore while pumping fluid down through the drill string from surface and through the flapper valves to the drill bit.

* * * * *